United States Patent [19]

Von Kohorn

[11] Patent Number: 4,945,460

[45] Date of Patent: Jul. 31, 1990

[54] GLARE-FREE ILLUMINATING APPARATUS

[76] Inventor: Henry Von Kohorn, 945 Treasure Ln., Vero Beach, Fla. 32963

[21] Appl. No.: 278,442

[22] Filed: Dec. 1, 1988

[51] Int. Cl.[5] ..... F21V 7/00

[52] U.S. Cl. ..... 362/290; 362/342; 362/268; 362/806; 362/267

[58] Field of Search ..... 362/267, 806, 290, 317, 362/331, 342, 808, 101, 268, 343, 327; 40/431

[56] References Cited

U.S. PATENT DOCUMENTS

| | | | |
|---|---|---|---|
| 3,581,275 | 5/1971 | Peterson | 362/290 |
| 4,594,646 | 6/1986 | Von Kohorn et al. | 362/101 |
| 4,616,304 | 10/1986 | Von Kohorn | 362/101 |
| 4,626,968 | 12/1986 | Von Kohorn | 362/122 |
| 4,630,177 | 12/1986 | Von Kohorn et al. | 362/32 |
| 4,672,513 | 6/1987 | Von Kohorn et al. | 362/32 |
| 4,686,611 | 8/1987 | Von Kohorn | 362/123 |
| 4,725,930 | 2/1988 | Von Kohorn | 362/145 |
| 4,729,069 | 3/1988 | Von Kohorn et al. | 362/32 |
| 4,758,934 | 7/1988 | Von Kohorn | 362/806 |
| 4,796,170 | 1/1989 | Pederson et al. | 40/564 |
| 4,811,179 | 3/1989 | Kometsu et al. | 362/293 |

FOREIGN PATENT DOCUMENTS

| | | | |
|---|---|---|---|
| 2804641 | 8/1978 | Fed. Rep. of Germany | 362/806 |
| 2291562 | 6/1976 | France | 362/806 |

*Primary Examiner*—Ira S. Lazarus
*Assistant Examiner*—D. M. Cox

[57] ABSTRACT

In an illuminating apparatus having an electric light source housed in a container permitting light to escape upwardly towards an object supported above and in close proximity to the light source, the improvement comprising two horizontal, vertically spaced sheets having apertures in vertical register disposed above the light source, said sheets acting as light baffles, so that light escapes upwardly in the shape of spreading light beams. The neck surfaces of the apertures are minimized and made non-reflective, so that observers are protected from the glare of the light source and from reflections of light from components of the apparatus.

14 Claims, 2 Drawing Sheets

GLARE-FREE ILLUMINATING APPARATUS

BACKGROUND OF THE INVENTION

The present invention relates to the lighting of objects having three-dimensional surfaces, such as plants, sculptures, merchandise and other defined objects.

It particularly relates to the glare-free illumination of objects intended to be centripetally viewed by a plurality of observers grouped around such lighted object. Conventional methods used to light three-dimensional objects involve the use of spotlights, ceiling lights, track lights and the like, normally beamed at and around the object to be illuminated from a distance, normally of several meters. Such lighting methods and devices have a number of disadvantages. A primary disadvantage stems from the distance at which conventional lights are mounted from the object to be illuminated. This causes not only loss of lumens, but a scattering of light. It is obvious that, the greater the distance, the more difficult it is to economically direct light with precision at three-dimensional objects having irregular configurations. An illustration would be a tall or spindly plant or an irregularly shaped object, in the lighting of which much of the light passes by and through such an object. Another serious drawback of such lighting methods lies in the glare produced not only by the light source itself, but by reflections of light from its components, which results in discomfort to the eyes of observers.

The present invention therefore is intended to be useful in lighting three-dimensional objects involving multi-direction and centripetal (radially inward) viewing by juxtapositioned observers on opposite sides of the object to be illuminated, irrespective of whether the lighted object is transparent, has openings or is irregularly shaped.

Known lighting devices are unsatisfactory when objects are displayed for viewing from all sides, e.g. free standing museum exhibits. The present invention addresses problems of this nature, as for instance lighting a sculpture in such fashion that observers grouped in a circle around the exhibit will each have an unobstructed, glare-free view of the uniformly lighted sculpture, or even of a sculpture having selected individual features lighted differently from the rest.

It therefore is a principal object of the invention to directionally illuminate three-dimensional objects, such as plants, sculptures and merchandise in such a manner that the source of light is not directly visible and glare is avoided.

It is another object of the present invention to provide an illuminating apparatus which not only conceals the light source itself, but comprises components minimizing or eliminating light reflections from such components.

It is yet another object to envelop three-dimensional objects positioned above and in close proximity to said apparatus in dispersed light from said apparatus in a uniform, economical and pleasing manner.

SUMMARY OF THE INVENTION

The above mentioned objects and other beneficial results are achieved by the apparatus described herein and shown in the drawings. It comprises a container, which is open at the top, or permits light to escape upwardly, and in which an electric light source is disposed on or near its bottom. Light impervious walls do not permit light to escape from said container, except in an upward direction, so as to illuminate an object positioned above said apparatus.

Two or more rigid horizontal structures, such as leaves or sheets, which are spaced from each other, are mounted on said container, so as to form partial upper closures and light baffles in or on said container. Each of said sheets is provided with apertures or perforations, said perforations being in at least partial vertical alignment with each other so that light shining upwardly passes through said perforations. Normally, at least the lower of said sheets is surrounded by the walls forming said container. Thus, said sheets form partial closures of the otherwise open container. At least the uppermost one of said sheets is shaped so as to comprise the smallest possible reflective surface area.

According to the present invention, the light source which may consist of one or more lamps, extends horizontally below essentially all of the perforations on said sheets. As a consequence, light shines and spreads upwardly, being however confined by said perforated sheet baffles to a plurality of upwardly spreading beams, such as inverted light cones or other upwardly spreading shapes. The spread, i.e. the angle of divergence of said light cones or other shapes is determined by the configuration of said perforations and by the distance between the perforated sheets. More closely spaced sheets result in more widely spreading light cones.

The angle of divergence of said light beams is chosen so that, at the height of the surfaces of the object or objects to be illuminated, the combined light of the plurality of light beams strikes said surfaces. Thus, for example, the light from upwardly spreading light cones, at a level of 15 centimeters above the apparatus, covers the entire horizontal cross-sectional area of said apparatus.

Preferred shapes of the apertures or perforations in the sheets forming the upper partial closures of said container are circles and squares. Other shapes may be utilized when special lighting accents are intended. If, for example, certain selected surfaces of an horizontally extending sculpture are to be illuminated, said apertures may take the shape of elongated slots directing light against said surfaces.

According to the present invention, the only parts of the illuminating apparatus that are both exposed to light and visible to observers, are the inside surfaces of the apertures in the uppermost of the sheets partially closing the container of the light source.

These inside surfaces, forming the necks of the apertures or perforations, are visible by observers grouped around the apparatus. Light impinging on said necks is reflected in an upward direction and is the only reflected light visible to observers, except for the intended reflections of light from the illuminated object iteself. According to the present invention, the light reflections from the neck of said apertures are minimized so as to be practically eliminated or so reduced in intensity as to be virtually unnoticeable.

This is achieved, for instance, by making the top sheet very thin and/or reducing the interior edge of said necks, when seen in cross-section, to the point of a wedge. Rounded configurations of said interior edge are equally effective. Thus, the surface area of said necks approaches the zero surface of a line. In addition, the remaining neck surfaces are made non-reflective. Although a zero surface is unattainable, in actual practice the non-reflective surface remaining is so small that any light that is reflected is negligible.

It therefore is a unique characteristic of the present invention that the illuminating apparatus has light conduits comprising baffles having reflective surfaces of minimal area exposed to view by observers,which surfaces are virtually invisible to such observers.

DETAILED DESCRIPTION OF THE INVENTION AND DRAWINGS

Figure 1:
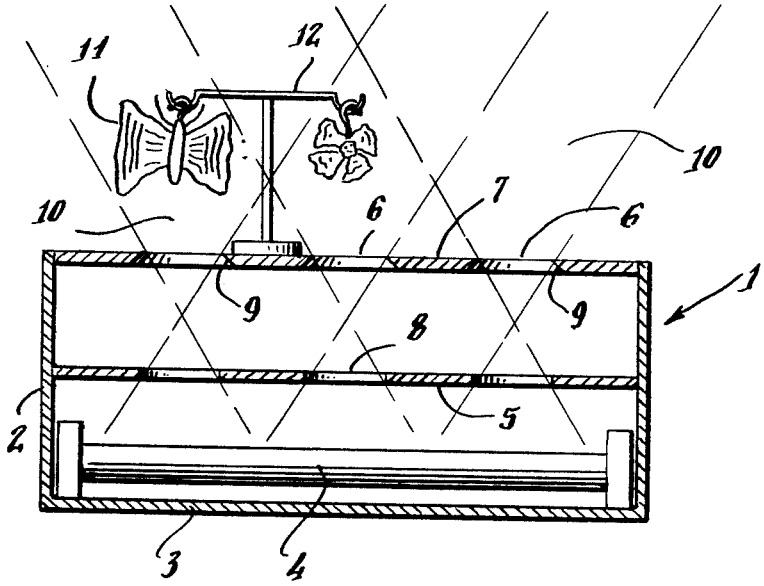
FIG. 1 is a diagrammatic cross-sectional view of the apparatus and of illuminated objects.

FIG. 1 is a diagrammatic cross-sectional view of apparatus 1, comprising light-impervious walls 2 and bottom 3. Light source 4, depicted as a fluorescent tube in an appropriate fixture, is mounted on or near bottom 3.

A first lower rigid and normally substantially light-impervious leaf or sheet 5 is horizontally mounted on and supported by walls 2. Sheet 5 is provided with a plurality of perforations 8, which may have any desired configuration and may vary in cross-sectional area. Sheet 5 is disposed in close proximity to light source 4 and preferably is not positioned more than 10 centimeters above said light source. Sheet 5 functions solely as a light barrier and, not being subject to any external forces, can be very thin and may consist of any unsupported sheet or film material.

Above sheet 5 is mounted a second upper rigid and light-impervious leaf or sheet 7. Sheet 7 also is horizontally mounted on and preferably supported by walls 2. Sheet 5 is provided with a plurality of perforations 6. The number of perforations 6 is essentially the same as that of perforations 8, said perforations 6 and 8 being at least partially in register, i.e. vertially aligned. Light shining upwardly from light source 4 passes through the conduit formed by perforations 8 and perforations 6. The configuration and cross-sectional area of perforations 6 may be similar to or may vary from those of perforations 8.

Sheets 5 and 7 are vertically spaced from each other and their vertical distance from each other is adjustable. Sheets 5 and 7 form a light conduit having the cross-section determined by perforations 6 and 8. Light is projected upwardly through said light conduit in the form of upwardly diverting cones 10. The degree of divergence depends on the relative size and shape of perforations 6 and 8 and on the vertical spacing between them. If sheets 5 and 7 are closely spaced, the angle of divergence of the light beams will be greater than if said sheets are more widely spaced. Appropriate electric wiring (not shown) connecting the light fixture to a power supply source is provided.

The object of minimizing reflections of said light from any of the components of said apparatus is achieved by exposing the eyes of observers only to light reflected by the centripetally facing innermost surfaces defining perforations 6 in upper sheet 7. Said vertical surfaces form necks 9 of perforations 6 and are the only surfaces struck by light from light source 4 and visible to observers. The vertical height of necks 9 is determined by the thickness of sheet 7 and is kept at the minimum required to withstand any external forces exerted on sheet 7, such as the weight of the object to be illuminated.

Figure 3:
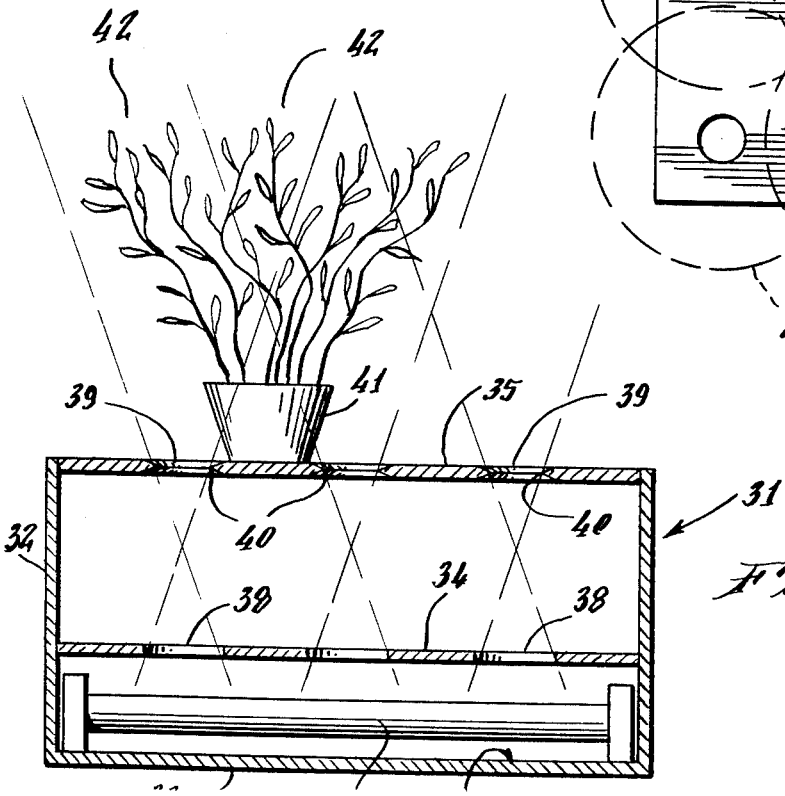
FIG. 3 is a diagrammatic cross-sectional view of the apparatus and of an illuminated plant, showing an upper perforated sheet wherein the interior edges of the perforations are wedge-shaped.

In a preferred embodiment, the circumferential edges forming necks 9 of perforations 6 are beveled or otherwise configured as wedges, so when seen in cross-section as depicted in FIG. 3, said edges come to a point. The result of reducing the surfaces of necks 9, from which light may be reflected, to a knife-like edge having a surface area approaching zero, eliminates or minimizes light reflections striking the eyes of observers.

Sheet 7 is of a light-impervious nature or covered by a light-impervious substance. If required, the surfaces forming necks 9 are given light absorbing or non-reflective properties.

The arrangement described hereinabove results in a plurality of defined and controllable upwardly spreading light cones capable of reaching an object disposed above said apparatus. The angle of divergence of said light cones is chosen so that, at the eye level of observers, their light is not directly visible to observers grouped around said apparatus. As essentially no light is reflected towards observers by any of the other components of the apparatus, the only light visible to observers is that reflected by the illuminated object.

The apparatus shown in FIG. 1 is intended to illuminate merchandise in the form of jewelry 11 supported by display stand 12 above and in turn supported by perforated sheet 7.

Figure 2:
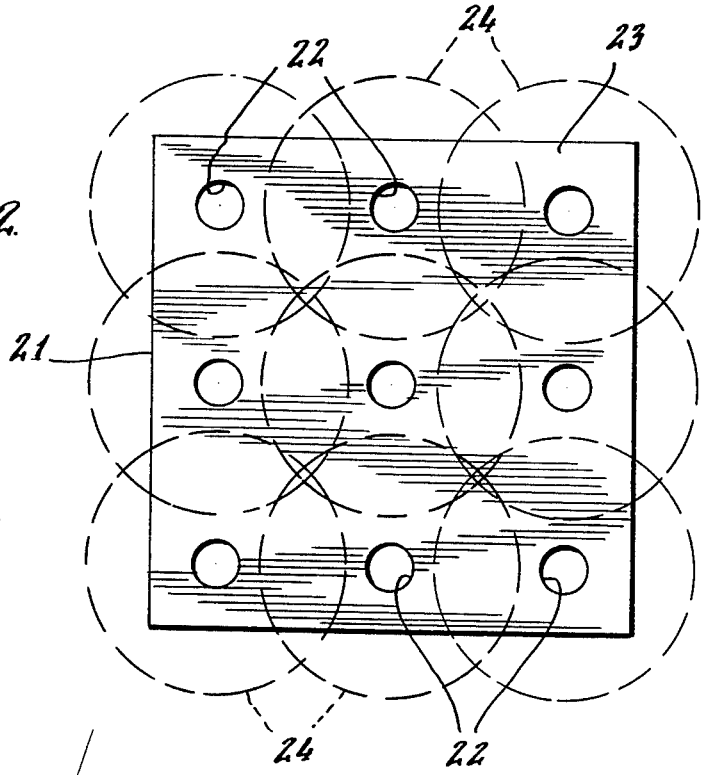
FIG. 2 is a diagrammatic top plan view of the apparatus.

FIG. 2 is a diagrammatic top plan view of container 21 of the apparatus, showing a circular configuration of perforations 22 in upper sheet 23. The circular circumferences 24 of the upwardly spreading light beams are shown in cross-section at an arbitrary height or distance above sheet 23, said height corresponding to that of the surfaces of the object to be illuminated. The circumferences of said light cones overlap, thus covering the entire area of container 21 and extending to some extent beyond the area defined by the walls of container 21.

In the diagrammatic cross-sectional view of the apparatus shown in FIG. 3 container 31 comprises side walls 32 and bottom 33, having an interior reflective surface 36. Lower sheet 34 is mounted close to light source 37 and has perforations 38. Upper sheet 35 is mounted at the top of walls 32 and has perforations 39. The wider spacing of sheets 34 and 35 results in a narrowing of the angle of divergence of the light beam 42 emanating from light source 37.

The interior, i.e. centripetally facing edges 40 of perforations 39 are wedge-shaped and come to a point when seen in cross-section, as depicted in FIG. 3. Edges 40 thus form a knife-like circular edge. As a result, vertually no light from light source 37 is reflected by sheet 35 towards the eyes of observers grouped around container 31. The necks of perforations 39 may have different shapes and may be rounded instead of wedge-shaped when seen in cross-section.

Sheet 35 is, for example, made of a rigid, black plastic material, such as acrylic plastic of sufficent strength to support a planter or flower pot 41 containing a plant to be illuminated.

Figure 4:
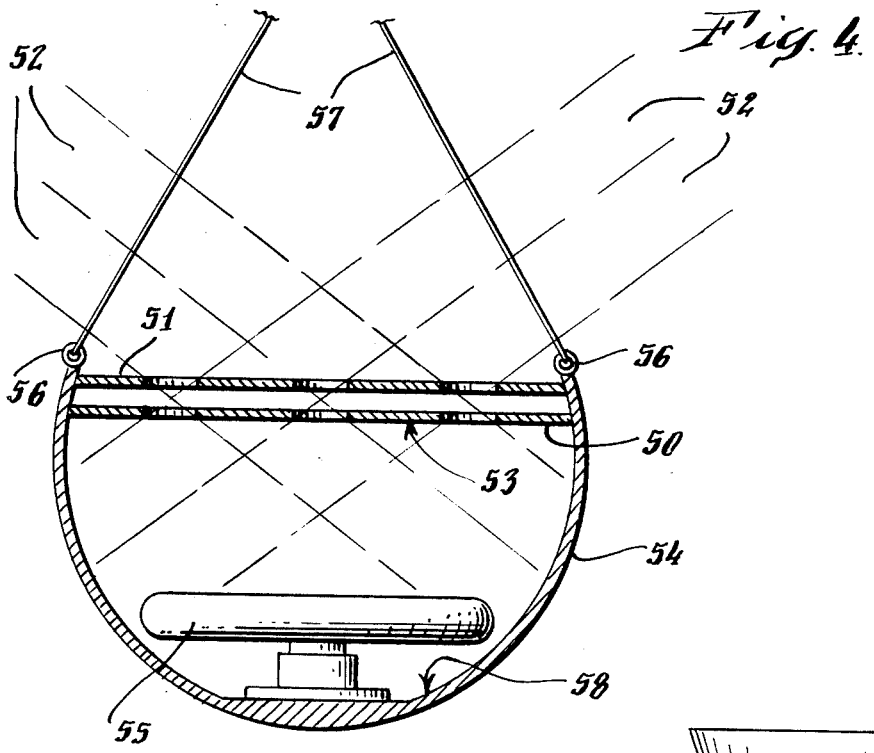
FIG. 4 depicts another embodiment of the apparatus in diagrammatic cross-sectional view.

FIG. 4 depicts a hanging bowl-shaped container 54 and circular fluorescent light source 55, shown in diagrammatic cross-section. In this embodiment, lower sheet 50 and upper sheet 51 are closely spaced, resulting in more widely spreading light beams 52. Upper perforated sheet 51 is strong enough to support a flower pot (not shown). Lower perforated sheet 50 has a reflective underside 53, reflecting upwardly shining light downwardly. Inner surface 58 of container 54 also is reflective and re-directs light shining downwardly in an upward direction. This process is repeated until the light escapes upwardly through perforations in sheets 50 and 51. Container 54 is provided with rings 56 for suspending the device by ropes 57.

Figure 5:
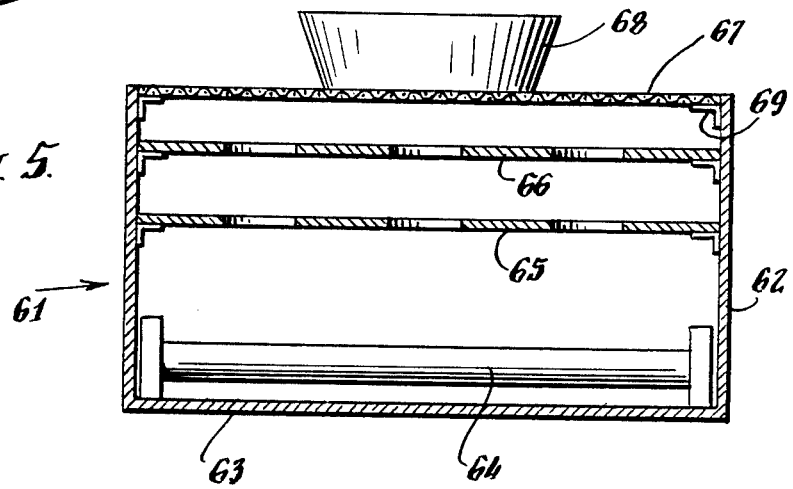
FIG. 5 depicts in diagrammatic cross-sectional view a support arrangement for the objects to be illuminated.

In the diagrammatic cross-section shown in FIG. 5, apparatus 61 comprises walls 62, bottom 63 and light source 64. Lower sheet 65 and upper sheet 66 are adjustably mounted in container 61 by means of brackets or other known, vertically adjustable devices. Walls 62 of container 61 extend vertically above upper sheet 66. Above sheet 66 and supported by container 61 is a rigid structure 67 which is formed by any open material, such as a lattice, grill, mesh, web, grid, expanded metal, or other expanded material. It is mounted on adjustable brackets 69 or other positioning devices and is capable of supporting one or more objects to be illuminated such as planter 68 containing a live or artificial plant (not shown).

Figure 6:
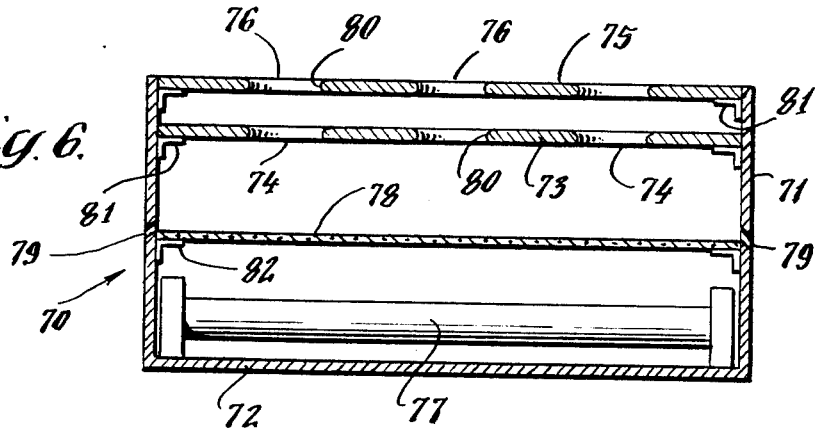
FIG. 6 is a diagrammatic cross-sectional view of the apparatus showing an upper perforated sheet, wherein the interior edges of the perforations are rounded.

FIG. 6 depicts apparatus 70 in diagrammatic cross-section. Walls 71 and bottom 72 are made of waterproof and light-impervious material. Lower sheet 73 and upper sheet 75 are adjustably supported by brackets 81 or other support means. Sheets 73 and 75 have perforations 74 and 76 respectively. The inner surfaces or edges 80 of at least perforations 76 in upper sheet 75 are rounded when seen in cross-section. Light projected upwardly by light source 77, after passing through perforations 74 in the light baffle constituted by lower sheet 73 is further constrained by upper sheet 75 acting as a second light baffle. The rounded configuration of the inner surface 80 of perforations 76 presents to the upwardly shining light no more than a line from which virtually no light is reflected towards the eyes of observers.

Apparatus 70 is further provided with horizontal, waterproof, transparent sheet 78, which for example consists of clear acrylic plastic and is supported by brackets 82 mounted on walls 71 in a watertight manner. Rain or other water can pass through perforations 74 and 76 and, after falling on sheet 78, is drained off through drainage means 79, which may be simple openings but which may also be provided with appropriate means to prevent light from being visible outside wall 71.

It should be understood that the light source may be of any incandescent, fluorescent or other type and may comprise a combination of different lamps. The container in which the lamp or lamps are mounted may have any configuration best suited to the object to be illuminated. Two or more horizontal perforated sheets may be used. The perforations may have any regular or irregular cross-section; the size and shape of the cross-sections is adapted to produce the desired lighting effect on the object to be illuminated, depending on the properties and shapes of the surfaces of such object. Thus the sizes and shapes of the apertures in the top sheet of the apparatus may vary and at least some of the configurations of said apertures may be selected to conform to the sizes and shapes of the surfaces to be illuminated.

Other applications, embodiments and configurations of the present invention may be devised by persons skilled in the art without deviating from the principal features described herein. These and any modifications covered by the doctrine of equivalents are intended to be included within the scope of the appended claims.

What is claimed is:

1. In an illuminating apparatus having an electric light source housed in a container permitting light to escape upwardly in the direction of an object supported above and in close proximity to said light source, an improvement for protecting observers grouped around said apparatus from direct view of the light source and from glare produced by reflections of light from surfaces of components of said apparatus, the improvement comprising:

a first lower horizontal sheet disposed above said light source, said first sheet having an underside which is reflective and also having a plurality of apertures permitting the upward passage of light; and a second upper light-impervious horizontal sheet, said second sheet having a plurality of apertures at least partially in vertical register with the apertures of said first sheet, wherein surfaces constituting necks of said second sheet apertures are non-reflective, said first and second sheets being vertically spaced from each other and said light source extending horizontally below substantially all of said apertures so that light escaping upwardly from said container passes through said apertures in said lower and upper sheets in a shape of a plurality of upwardly spreading light beams, the angle of divergence of the light beams being determined by size of said apertures and by distance of said lower sheet from said upper sheet and, so that observers grouped around said illuminating apparatus are completely protected from a direct view of the light source and are substantially protected from glare produced by reflections of said light from surfaces of components of said apparatus.

2. The improvement in illuminating apparatus according to claim 1, wherein said container is provided with at least one interior reflective surface.

3. The improvement in illuminating apparatus according to claim 1, wherein said object is supported by said second sheet.

4. The improvement in illuminating apparatus according to claim 1, wherein said object is supported by a rigid structure selected from the group consisting of an open lattice, grill, mesh, web, grid, and expanded metal, said structure being supported by said container above said second sheet.

5. The improvement in illuminating apparatus according to claim 1, wherein at least some of said apertures are shaped to conform to the shapes of the surfaces of the object to be illuminated.

6. The improvement in illuminating apparatus according to claim 1, comprising waterproof transparent shielding means disposed in said apparatus above said light source in a watertight manner to shield said light source from water.

7. The improvement in illuminating apparatus according to claim 1, said improvement further comprising water drainage means provided above said shielding means.

8. The improvement in illuminating apparatus according to claim 1, wherein the cross-section of the neck forming the innermost edge of an aperture comes to a point.

9. In an illuminating apparatus having an electric light source housed in a container permitting light to escape upwardly in the direction of an object supported above and in close proximity to said light source, an improvement for protecting observers grouped around said apparatus from a direct view of the light source and from glare produced by reflections of light from surfaces of components of said apparatus, the improvement comprising:

a first lower horizontal sheet disposed above said light source, said first sheet having a plurality of apertures permitting the upward passage of light;

a second upper light-impervious horizontal sheet, said second sheet having a plurality of apertures at least partially in vertical register with said first sheet apertures wherein surfaces constituting necks of said apertures in said second sheet is non-reflective, said first and second sheet is being vertically spaced from each other and said light source extending horizontally below substantially all of said apertures so that light escaping upwardly from said container passes through said apertures in said lower and upper sheets in a shape of a plurality of upwardly spreading light beams, the angle of divergence of said light beams being determined by the size of said apertures and by the distance of said lower sheet lower sheet from said upper sheet and, so that observers grouped around said illuminating apparatus are completely protected from a direct view of the light source and are substantially protected from glare produced by reflections of said light from surfaces of components of said apparatus;

waterproof transparent shielding means disposed in said apparatus above said light source in a watertight manner to shield said light source from water; and water drainage means provided above said shielding means.

10. The improvement in illuminating apparatus according to claim 9, wherein said container is provided with at least one interior reflective surface.

11. The improvement in illuminating apparatus according to claim 9, wherein at least some of said apertures are shaped to conform to shapes of surfaces of the object to be illuminated.

12. In an illuminating apparatus having an electric light source housed in a container permitting light to escape upwardly in the direction of an object supported above and in close proximity to said light source, an improvement for protecting observers grouped around said apparatus from a direct view of the light source and from glare produced by reflections of said light from surfaces of components of said apparatus, said improvement comprising:

a first lower horizontal sheet disposed above said light source, said first sheet having a plurality of apertures permitting the upward passage of light;

a second upper light-impervious horizontal sheet, said second sheet having a plurality of apertures at least partially in vertical register with said apertures of said first sheet wherein surfaces constituting necks of said second sheet apertures are non-reflective, said first and second sheets being vertically spaced from each other, said light source extending horizontally below substantially all of said apertures so that light escaping upwardly from said container passes through said apertures in said lower and upper sheets in a shape of a plurality of upwardly spreading light beams, the angle of divergence of said light beams being determined by the size of said apertures and by the distance of said lower sheet from said upper sheet and, so that observers grouped around said illuminating apparatus are completely protected from a direct view of the light source and are substantially protected from glare produced by reflections of said light from surfaces of components of said apparatus; and wherein the cross-section of at least one of said necks forms an innermost edge of an aperture and comes to a point.

13. The improvement in illuminating apparatus according to claim 12, wherein said container is provided with at least one interior reflective surface.

14. The improvement in illuminating apparatus according to claim 12, wherein at least some of said apertures are shaped to conform to shapes of surfaces of the object to be illuminated.

* * * * *